United States Patent [19]

Vartanian

[11] 4,067,736

[45] Jan. 10, 1978

[54] METAL POWDER PRODUCTION

[75] Inventor: Haig Vartanian, Newton, Mass.

[73] Assignee: NRC, Inc., Newton, Mass.

[21] Appl. No.: 693,002

[22] Filed: June 4, 1976

Related U.S. Application Data

[62] Division of Ser. No. 484,780, July 1, 1976, Pat. No. 3,992,192.

[51] Int. Cl.[2] ..... B22F 9/00

[52] U.S. Cl. ..... 75/251

[58] Field of Search ..... 75/.5 BB, .5 AB, 251

[56] References Cited

U.S. PATENT DOCUMENTS

| | | | |
|---|---|---|---|
| 3,295,951 | 1/1967 | Fincham et al. | 75/.5 BB |
| 3,473,915 | 10/1969 | Pierret | 75/.5 BB |
| 3,748,106 | 7/1973 | Davis et al. | 75/.5 BB |
| 3,829,310 | 8/1974 | Mahy | 75/.5 BB |
| 3,989,511 | 11/1976 | Fey et al. | 75/.5 BB |

*Primary Examiner*—W. Stallard

*Attorney, Agent, or Firm*—Jerry Cohen

[57] ABSTRACT

Metal powders of agglomerated form having a uniform specific surface area for various size fractions thereof in a size spectrum extending from 3 microns to 10 mesh are produced by heating a charge of a salt source of the metal, pre-coated with reducing agent, to initiate an exothermic reduction reaction and continuing application of heat after termination of the exotherm heat output to modify powder size and agitating the reaction charge substantially throughout and further heating periods to maintain homogeneity. The charge may be diluted with inert salts to modify the necessary minimum hold temperature and the properties of resultant powders. The metal may comprise one or more of tantalum, columbium, zirconium, vanadium, hafnium, tungsten, titanium, thorium, chromium, yttrium, rare earths, germanium, manganese, beryllium, boron, iron, nickel and platinum group metals.

4 Claims, 5 Drawing Figures

METAL POWDER PRODUCTION

CROSS REFERENCE TO RELATED APPLICATIONS

This application is a division of my copending application Ser. No. 484,780, filed July 1, 1976, now U.S. Pat. No. 3,992,192, granted Nov. 16, 1976.

BACKGROUND OF THE INVENTION

The present invention relates in general to reduction of metal bearing salts and more particularly to production of metal powders selected from the class consisting of the valve metals, tantalum and columbium, for use in production of porous sintered anodes usable in wet or solid electrolytic capacitors.

Such powders may be produced by reacting a salt source of such metals, e.g., $K_2TaF_7$, $Na_2TaF_7$, $Na_3TaF_8$, $Na_3NbF_8$, with a reducing agent such as Na, K, Li or NaK. The reducing conditions may comprise, among other possibilities, melting the salt in a reactor and adding molten reducing agent until their respective quantities are substantially stoichiometrically matched, all the while stirring the melt; premixing stoichiometric quantities of powders of salt and reducing agent in a bomb reactor and heating up; or premelting reducing agent and stirring or mulling particles of the reducing agent therein to coat the particles of the reducing agent and then heating to reduction reaction temperatures.

The charge of valve metal containing salt may be diluted with inert eutectic fluxing ingredients such as alkali metal salts in any of the above processes to reduce the necessary temperature for holding the charge in molten state taking account of reaction products (excepting end product metal) as well as starting materials.

After a hold period at melting temperatures for about one-half to two hours, the stirring is discontinued and the reaction products are cooled. Metal powder is removed from the now solid mass by crushing and leaching.

It is an important object of the present invention to provide metal powders having usable and uniform high surface area in high yields.

It is a further object of the invention to provide a metal powder selected from the group consisting of tantalum and columbium which has high capacitance and low leakage.

It is a further object of the invention to produce powder having good handling properties for anode production consistent with one or more of the preceding objects.

It is a further object of the invention to limit reduction reaction feed molar dilution ratio to 4:1 or less consistent eith one or more of the preceding objects.

It is a further object of the invention to obtain high yield of high surface area powder consistent with one or more of the preceding objects.

It is a further object of the invention to enhance controllibility of the reduction reaction consistent with one or more of the preceding objects.

It is a further object of the invention to eliminate the need for thermal agglomeration consistent with one or more of the preceding objects.

It is a further object of the invention to provide high metal production per reduction run consistent with one or more of the preceding objects.

It is a further object of the invention to eliminate the need for size sorting above 3 microns consistent with one or more of the preceding objects.

SUMMARY OF THE INVENTION

According to the invention, particles of a metal bearing salt are premixed with a molten reducing agent and coated with said molten reducing agent by mulling — stirring the particles within the molten reducing agent to insure uniform coating throughout. The salt and reducing agent are selected as constituents of an exothermic reaction which initiates at a temperature above the reducing agent's melting point and produces sufficient heat to cause a temperature rise of the charge to above the solidus temperature of the resultant salt mixture. The charge is then heated for at least 15 minutes to hold the reaction products at said elevated temperature or higher with the charge being held molten except for metal powders therein. Stirring is continued throughout the heat up to elevated temperatures and subsequent hold.

While the mechanisms involved are unknown, it appears that metal is transferred from high surface free energy sites to low energy sites through dissolution in the molten salts and redeposition at the low energy sites. This produces inter-particle bridging during the hold period, thereby strengthening particle agglomeration. Conditions during the reduction and hold periods are also favorable for sintering of the fresh powders.

The charge may be diluted by inert fluxing agents, e.g. NaCl or other alkali metal salts, to reduce the necessary hold temperature. Also, powders produced from the reduction process may be lightly sintered and broken down again, i.e. presintered, to produce a more agglomerated structure which has improved handling properties for purposes of anode production.

As used herein, "primary" powders refers to powders of elemental metal produced in a reduction process from a salt of the metal and "secondary" powders of the same metal refers to powders as produced by presintering such primary powders and crushing the sintered block to produce a new powder form, generally characterized by agglomerated structure (i.e., powder particles which are themselves assemblages of smaller powder particles).

Where the metal salt is $K_2TaF_7$, and the reducing agent is sodium, the resultant primary metal powders of the reduction have a spectrum of particle size distributions from very coarse — on the order of 10 mesh to very fine e.g. 3 micron size, usually with over 80% (by weight) in the range of 3 microns to 10 mesh. Within fractions sampled from the 3 micron to 10 mesh range, the bulk density, specific surface area and specific capacitance of the powder produced in accordance with preferred embodiments of the invention are essentially constant. These characteristics are contrary to the characteristics of prior powders produced under mulled, but not stirred, or unmulled reduction conditions which show over 2:1 ratio in both this specific surface area and specific capacitance for different powder size fractions between 10 mesh and 3 microns and substantial bulk density varian. However, the prior art powders do not have this property unless fractions, preferably selected over a close size distribution, are presintered and reground. This produces secondary powder agglomerates with their specific areas and specific capacitance characteristics also essentially constant over the same range.

Other metals produced through the present invention show similar specific surface area uniformity over a spectrum of powder size distribution from 10 mesh (U.S. Standard) to 3 microns. They also show bulk density uniformity.

The process is a true batch reduction reaction process providing an equal residence time of all reactants in a homogeneous admixed state as opposed, for instance, to processes wherein the reducing agent is added continuously after reduction is in progress or to processes where ingredients are premixed but allowed to segregate in the course of the reaction and hold times. It has been discovered that the present process affords high yields of controllable and uniform metal powder bulk density and surface area characteristics generally and more particularly, as applied to tantalum and columbium, affords high yields of controllable and uniform electrolytic capacitor characteristics in capacitors made from these metals.

Although in the process of the present invention, the stirring or other agitation during the exothermic reduction reaction and during the following high temperature hold period continually breaks down the very long range order of at least a majority of the reaction charge, it is gentle enough to preserve the shorter range order. In the absence of such agitation, compositional segregation during reaction and subsequent hold period would produce a gradation of reaction products, thereby departing from a true batch reaction. The agitation operation of the present invention minimizes such spatial segregation while the introduction of reducing agent before initiation of the reaction allows each forming metal particle to see a uniform temporal environment thus approaching true batch processing conditions. Long range order may be defined as the order observable over 0.5 inch or longer.

Other objects, features and advantages of the invention will be apparent from the following detailed description of preferred embodiments, taken together with the accompanying drawing, in which,

DETAILED DESCRIPTION OF PREFERRED EMBODIMENTS

Figure 1:
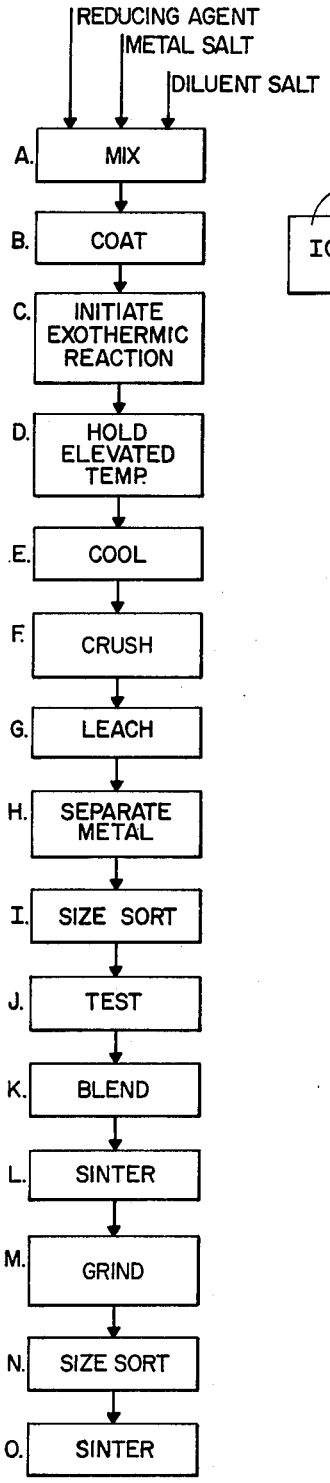
FIG. 1 is a block diagram of the process of a preferred embodiment.

Referring now to FIG. 1, a preferred embodiment of the powder production process of the invention is shown in a flow chart of consecutive steps applied illustratively to a $K_2TaF_7$-NaCl-Na charge but having general application to other ingredients. The chart also includes optional additional steps useful for some grades of powder and a last step of sintering to produce porous blocks such as electrolytic capacitor anodes. The steps are:

A. DRYING AND MIXING AND B. COATING

The metal-containing salt, e.g., $K_2TaF_7$, is charged into a reactor vessel. Optionally a diluent salt, e.g., NaCl, may also be added.

The reactor vessel is sealed and then heated to an elevated temperature above 100° C., all the while stirring the salt charge. Molten sodium is then rapidly added to the charge with inert gas atmosphere. The vessel heating is controlled to maintain a temperature that keeps the sodium molten, but is sciently low to avoid initiating the exothermic reaction between the sodium and $K_2TaF_7$. The charge is agitated, through use of an internal stirrer within the vessel or by tumbling the vessel, to ensure homogeneous admixture of the charge during the addition of sodium. The molten sodium permeates through the charge and coats tee salt particles therein through this mulling operation. The stirring is such as to minimize the layer of excess sodium, if any, which would otherwise form on top of the charge.

C. INITIATE EXOTHERMIC REACTION

External heating is then increased to raise charge temperature to a level which initiates an exothermic reaction, typically 200°–400° C. for sodium and $K_2TaF_7$. The reaction proceeds very rapidly and raises the charge temperature. Agitation of the charge is continued throughout the reaction. Temperature rise due to the exotherm levels off at 600°–800° C. in five to ten minutes from initiation of the reaction and the reduction reaction is essentially completed at this point.

D. HOLD ELEVATED TEMPERATURE

External heating is however continuously applied thereafter to raise and hold an elevated temperature for a hold period of fifteen minutes to four hours. Agitation of the charge is continued throughout at least an initial portion of the hold period, preferably throughout the hold period.

The time and temperature of the hold period are adjusted to control particle size, leakage and flow properties of metal produced in the reaction. The percent of fine particles (−325M) obtainable from the charge is reduced with increased time and temperature of hold. This reduction of fines may improve flow properties of the main mass. The hold period is typically up to three hours at 900°–1000° C., when producing tantalum powder for electrolytic use.

The charge agitation prevents formation of skeletal metal-salt or metal structures larger than about 0.5 inches and limits them to smaller coarse powder agglomerates within the charge and continuously recirculates these powder agglomerates and smaller metal powder particles initially formed in the exothermic reaction together with $K_2TaF_7$ and NaCl diluent (if used) so that homogeneous distribution of all species is fostered. The recirculation action includes lifting of materials and does not involve substantial chopping or grinding.

The metal powders and powder agglomerates are suspended within the molten salt mass and recirculated therein by the agitation to prevent gradations of reactant concentration at different height levels within the melt.

E. COOLING

Stirring and external heating are terminated, and the charge is cooled. The internal stirrer, if any, is preferably withdrawn from the charge before cooling so that such stirrers will not be frozen in.

F-H. CRUSHING, LEACHING, METAL SEPARATION

The reaction products are crushed to produce particles of the reaction products. The particles are leached through several cycles to remove salt products of reaction from the metal, leaving metal powders having a spectrum of size distribution therein.

I-K. SIZE SORT, TEST AND BLEND

After leaching the powder, extremely fine particles may be removed. Portions of the powder are processed through to a prototype of final usage to determine powder properties and lots may be blended to achieve the desired stock. The present invention allows elimination or reduction of much of the usual sorting, testing and blending in certain instances.

L-N. SINTER, GRIND AND SCREEN, I.E. THERMAL AGGLOMERATION

The natural agglomeration of the metal powder and its flow properties may be enhanced by presintering, a known process per se which comprises lightly sintering the powder into a block and grinding the block. The resultant aggolmerated powder may be screened to utilize desired fractions.

O. SINTER OR OTHER FINAL USAGE

The powders may be compressed into blocks and sintered or poured into a mold and sintered there to form a coherent porous structure, usable as filters, anodes or cathodes of electrolytic cell devices, catalysts or catalyst carriers, resistors and other devices dependent on controlled porosity and high internal surface area. In some usages, such as capacitor anodes, the sintered block is electrolytically anodized to form a dielectric oxide coating over the internal surfaces of its pore structure and then impregnated with electrolyte, contacted with a counter-electrode and packaged to provide a capacitor.

Figure 2:
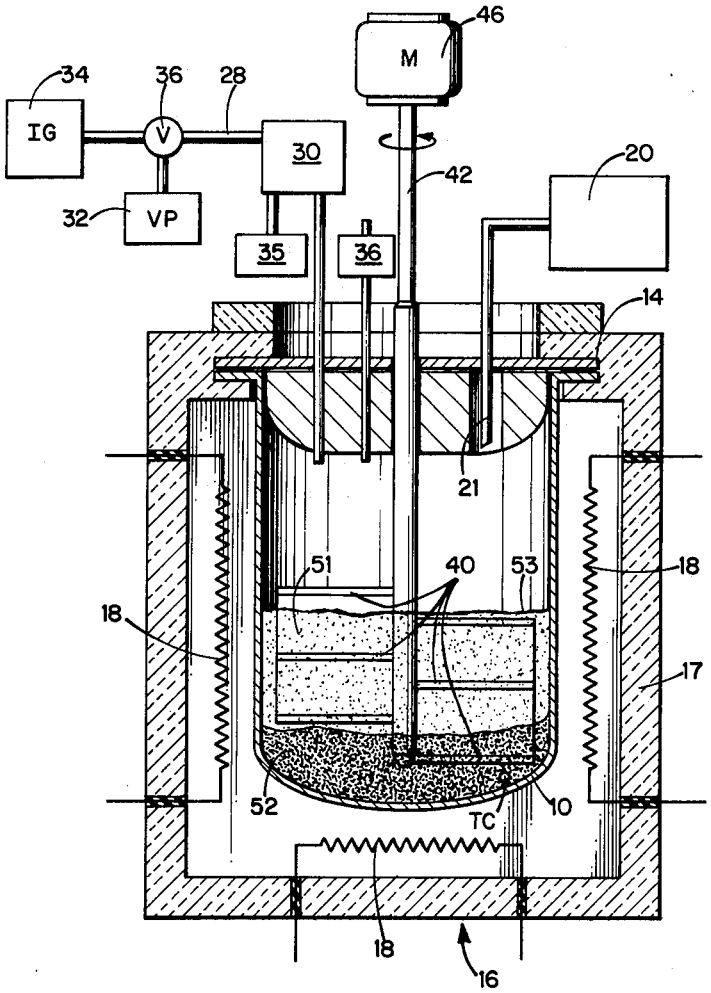
FIG. 2 is a cross-section view of a reactor vessel used in said process.

Referring now to FIG. 2, there is shown a reactor vessel 10 which is of the general type described in U.S. Pat. No. 2,950,185 of Hellier et al. The stirrer blades 40 are modified to be of low height and afford high shear and the power of the driving motor is stepped up to allow the stirrer to work solid particles in addition to the molten mass stirring requirement of the prior device. The vessel has a cover 14. Stirrer blades are spaced to circulate the charge, particularly providing a continuous lifting action with gentle contact which breaks up long range order. After the hold period, the blade is stopped and the blade assembly may be left in the charge, or preferably, lifted out of the charge to occupy the upper half of the vessel and be clear of the charge during the cool down to avoid freezing in. The stirrer speed is preferably below 100 revolutions per minute.

The vessel is in a furnace 16 with heaters 18 and and insulation mantle 17. Sodium is fed from a supply 20 in molten form through port 21. A reflux condenser 30, evacuation line 28, vacuum 32, inert gas source 34, and valve system 36 are provided for gas handling and to retain sodium at various stages of the process. An inner thermocouple indicated at TC measures temperature within the salt charge.

At the end of a cycle, a separate portion of the reflux condenser 30 can be used to condense boiled off unreacted sodium into an auxilliary storage tank 35. A pressure relief valve 36 is provided for venting overpressure without breaking the hermetic seal of the system during heating.

After completion of the reduction reaction and cooling of the charge, the charge is consistently found to comprise two distinct layers — a white salt solid layer 51 comprising a very low tantalum value content and a dark grey layer 52 of fine grained metal salt mixture containing nearly all of the tantalum metal produced in the reaction. Optionally, further processing to recover tantalum powder may be limited to layer 52. Layers 51 and 52 are readily removable from each other and from the vessel. It is also found that inwardly extending metal growths from the side wall of the vessel, such as occur in the process described in said Hellier et al patent are substantially avoided in the practice of the present invention. A thin layer 53 of NaK may be formed along the top of the charge.

The practice of the invention and its contrasts to the prior art in processing steps and resultant products are further illustrated by the following non-limiting Examples.

EXAMPLE 1

Three basic types of reduction procedures are compared; these are

A. Sodium-mulled tantalum double salt reduction in which stirring is discontinued after mulling.

B. Sodium-mulled tantalum double salt reduction in which stirring is continued throughout the run up to the end of the high temperature hold period.

C. Continuous sodium addition to molten salt during reduction period ("unmulled") as taught in U.S. Pat. No. 2,950,185.

A. SODIUM MULLED, UNSTIRRED REDUCTION

A number of unstirred reactor runs were carried out using a 4 inch diameter reactor, (a laboratory scale version of the reactor shown in FIG. 2). Runs at 2:1 molar dilution (0.30 weight dilution, $NaCl/K_2TaF_7$) with hold periods of 1, 2, and 4 hours were made. The reaction mass was removed from each run by separate removal of 1 inch deep stratum. The metal salt from each stratum (layer) was individually leached.

Physical and electrical properties on powders from each stratum show that the reaction product is nonhomogeneous.

In general, the surface area and capacity was greatest for powder from the top stratum and progressively decreased with each lower stratum. The observed gradient in physical and electrical properties of static bed runs has an analogous gradient in the distribution of fused salt (KCl, NaF) in the reaction mass (metal salt). The top stratum or "crust" has a scoria-like structure; being structured with a high density of substantially empty voids. Below this tantalum-rich crust the proportion of fused salt progressively increases, and a thin layer of salt approximately ¼ inch) is usually found at the bottom of the reactor.

B. SODIUM MULLED, STIRRED REDUCTIONS

A series of stirred reduction runs were carried out in a 4 inch reactor (B1), as well as in 24 inch diameter reactor (B2) as shown in FIG. 2. These runs were continuously stirred through sodium mulling, the reaction exotherm and during the high temperature hold period (950° ± 10° C); after stirring was discontinued and the reactor cooled. These runs were 0.3 weight dilution, $NaCl/K_2TaF_7$.

Unlike the unstirred reductions (A), substantially all of the tantalum metal occurred as a dense layer intimately mixed with salt located at the bottom of the reactor. Fused salt (white to light gray) was located above the tantalum metal-soft bed and extended to the top surface as shown in FIG. 2.

In sharp contrast to the A run the powder from stirrer reductions (B) is found to resemble the properties of an agglomerated type powder; both surface area and capacitance are only weakly related to the nominal size of particles.

C. CONTINUOUS ADDITION (RUN C)

Tables B1 and C below show physical properties of the runs identified by the same references including weight % distribution of different size fractions thereof and the properties of each size fraction.

Specific surface area is plotted against powder size for runs A; B1, B2 and C in FIG. 4.

EXAMPLE 2

Reaction conditions, powder distribution and fraction properties and main mass properties are given for the above described run B2 in Table B2 below. A portion of the B2 product was presintered and presintering conditions and properties of the resultant powder are given in Table B2P below. Similar runs B3 and B4 without thermal agglomeration were made and portions thereof (B3P and B4P) were thermal agglomeration and processing conditions and properties of resultant powders are given in Tables B3, B3P, B4 and B4P below.

In the tests powder was pressed to a 6.0 g/m³ green density, sintered at either 1650° C. for 15 minutes or 1700° C. for 30 minutes, anodized in 0.1% $H_3PO_4$ to 100 volts and tested at 70 volts in a wet electrolyte (30% $H_2SO_4$).

Table B1

| | | Mulled, Stirred Reduction | | | | | | |
|---|---|---|---|---|---|---|---|---|
| Screen Fraction (Mesh) | Oxygen (ppm) | FAPD (microns) | Porosity % | S.A. ($cm^2/g$) | CV/g (μf-V/g) | L/C (μa/μf) | Lg (μa/g) | Wt. (%) |
| 12/40 | 1140 | 4.3 | 79.2 | 2800 | 6480 | .03 | 1.8 | 18.0 |
| 40/100 | 1180 | 4.2 | 80.0 | 3021 | 6510 | .03 | 2.1 | 13.1 |
| 100/200 | 1400 | 3.5 | 80.0 | 3226 | 6630 | .03 | 2.0 | 12.8 |
| 200/325 | 1360 | | | 3301 | 6710 | .02 | 1.4 | 23.6 |
| 325/10μ | 2270 | 2.8 | >80 | 3908 | 7230 | .05 | 3.3 | 17.2 |
| 40/10μ | 1854 | 3.6 | 80.0 | 3171 | 7040 | .03 | 2.3 | |

Table C

| | | Continuous Sodium Addition Reduction | | | | | | |
|---|---|---|---|---|---|---|---|---|
| | | | | S.B.D. ($g/cm^3$) | | | | |
| 12/40 | 780 | — | — | 4.46 | 1840 | .16 | 2.9 | 21.9 |
| 40/100 | 940 | — | — | 3.98 | 1930 | .23 | 4.4 | 14.3 |
| 100/200 | 1016 | 18.0 | 72.8 | 4.06 | 2.60 | .11 | 2.4 | 8.6 |
| 200/325 | 1092 | 14.8 | 72.0 | 3.71 | 2670 | .02 | .64 | 8.1 |
| 325/3μ | 1060 | 7.2 | 67.8 | 4.52 | 4840 | .01 | .52 | 46.7 |

Table B2

| | | | | | | | | | |
|---|---|---|---|---|---|---|---|---|---|
| 1. Reaction Conditions | | | | | | | | | |
| Charge: | 126 lb. $K_2TaF_7$ | | | | | | | | |
| | 37.5 lb. NaCl | | | | | | | | |
| | 36.0 lb. Na (97% stoichiometric amount) | | | | | | | | |
| Hold Temperature: | 950° C. | | | | | | | | |
| Hold Time: | 1.0 hours | | | | | | | | |
| 2. Powder Distribution and Fraction Properties | | | | | | | | | |
| | Wt. (%) | S.B.D. ($g/cm^3$) | S.A. $cm^2/g$ | O (ppm) | Ts (° C) | ts (min) | $D_s$ ($g/cm^3$) | CV/g (μf-V/g) | Lg (μa/g) |
| + 12M | 1.2 | — | — | — | | | | | |
| − 12M+ 40M | 20.6 | 2.33 | 897 | — | 1650 | 15 | 6.8 | 6070 | 4.1 |
| − 40M+ 100M | 31.7 | 2.30 | 969 | 564 | 1650 | 15 | 6.7 | 6310 | 5.1 |
| −100M+200M } | 22.6 | 2.32 | 1089 | 576 | 1650 | 15 | 6.7 | 6130 | 4.7 |
| −200M+325M | | 2.35 | 1138 | 564 | 1650 | 15 | 6.5 | 5950 | 4.4 |
| −325M+3μ | 23.9 | 2.75 | 1232 | 614 | 1650 | 15 | 6.6 | 7160 | 4.6 |
| 3. Powder Fraction, −40M+3μ | | | | | | | | | |
| FAPD(μ) | | | | | | | | | |
| 9.5 | ~ 98% | 2.98 | 1086 | 590 | 1650 | 15 | 7.1 | 6600 | 5.4 |
| 9.5 | ~ 98% | | | 590 | 1700 | 30 | 7.2 | 5590 | 1.5 |
| 4. Powder of B23 above thermally agglomerated at 1500° C for 60 mins. | | | | | | | | | |
| 10.4 | 100% | 2.38 | 939 | — | 1650 | 15 | 6.5 | 6020 | 3.3 |
| 10.4 | 100% | 2.38 | 939 | — | 1700 | 30 | 6.4 | 4930 | 1.7 |

Table B3

| | |
|---|---|
| 1. Reaction Conditions | |
| Charge: | 126 lb. $K_2TaF_7$ |
| | 37.5 lb. NaCl |
| | 36.0 lb. Na (97% stoichiometric) |
| Hold Temp. | 950° C |
| Hold Time | 40 min. |

Table B3-continued

| 2. Powder Distribution and Fraction Properties | Wt. (%) | S.B.D. (g/cm³) | S.A. cm²/g | O (ppm) | Ts (° C) | ts (min) | $D_s$ (g/cm³) | CV/g (μf-V/g) | Lg (μa/g) |
|---|---|---|---|---|---|---|---|---|---|
| + 12M | 0 | | — | — | 1650 | 15 | | | |
| − 12M+ 40M | 4.4 | | | — | 1650 | 15 | | | |
| − 40M+100M | 14.1 | 1.35 | 2184 | — | 1650 | 15 | 7.0 | 6610 | 5.4 |
| −100M+200M | } 28.2 | 1.53 | 2593 | — | 1650 | 15 | 7.4 | 7260 | 5.6 |
| −200M+325M | | 1.78 | 2773 | — | 1650 | 15 | 7.7 | 7840 | 2.0 |
| −325M+3μ | 52.8 | 1.95 | 3357 | — | 1650 | 15 | 7.9 | 9140 | 4.8 |
| 3. Powder Fraction −40M+3μ | | | | | | | | | |
| | | | | FAPD (μ) | | | | | |
| 3.2 | ~98% | 1.97 | 2926 | 2570 | 1650 | 15 | 7.8 | 8790 | 2.8 |
| | | | | | 1700 | 30 | 8.7 | 6250 | 1.1 |

Table B3P

| 4. Powder of B33 above thermally agglomerated at 1500° C for 60 min. | | | | | | | | | |
|---|---|---|---|---|---|---|---|---|---|
| 9.0 | 100% | 1.96 | 1186 | 2470 | 1650 | 15 | 6.5 | 7370 | 1.5 |
| 12.0 | 100% | 1.96 | 1334 | 2130 | 1700 | 30 | 6.8 | 6090 | 0.5 |
| 12.0 | 100% | 1.96 | 1334 | 2130 | 1700 | 30 | 6.5 | 6190 | 1.1 |

Table B4

| 1. Reaction Conditions | |
|---|---|
| Charge: | 252 lb. $K_2TaF_7$<br>75 lb. NaCl<br>72 lb. Na (97% stoichiometric) |
| Hold Temp. | 950° C. |
| Hold Time | 1 hour |

| 2. Powder Distribution | Wt. (%) | S.B.D. (g/cm³) | S.A. cm²/g | O (ppm) | Ts (° C) | ts (min) | $D_s$ (g/cm³) | CV/g (μf-V/g) | Lg (μa/g) |
|---|---|---|---|---|---|---|---|---|---|
| + 12M | 0 | | | | | | | | |
| − 12M + 40M | 15.8 | | 2393 | | 1650 | 15 | 7.1 | 8170 | 7.2 |
| − 40M+100M | 38.7 | 1.35 | 1898 | | 1650 | 15 | 7.2 | 8050 | 6.6 |
| −100M+200M | } 26.4 | 1.53 | 1967 | | 1650 | 15 | 7.2 | 7930 | 5.9 |
| −200M+325M | | 1.78 | 2101 | | 1650 | 15 | 7.3 | 7840 | 5.7 |
| −325M+3μ | 18.9 | 1.95 | 1990 | | 1650 | 15 | 7.1 | 8400 | 6.5 |
| 3. Main Mass Fraction −40M+3μ | | | | | | | | | |
| FAPD(μ) | | | | | | | | | |
| 10.0 | | 2.96 | 2081 | 790 | 1650 | 15 | 7.4 | 7300 | 4.9 |
| 4. Powder of B43 above thermally agglomerated at 1500° C for 60 mins. | | | | | | | | | |
| 13.0 | | 2.95 | 1334 | | 1650 | 15 | 6.8 | 7510 | 2.9 |

EXAMPLE 3

Additional reduction runs were made in the same manner as the above described B runs with substantially similar results. The primary powders produced by mulling-stirred reduction - stirred hold - cooling crushing and leaching had 15–55% (by weight) −325 Mesh fractions. After removing −3 micron fines and coarse particles (+40 Mesh), if any, the main mass of such primary powders exhibited surface areas of 2000–3500 cm²/g and oxygen levels of 800–2600 ppm. Portions of such powders were presintered and ground; other portions were processed as primary powders without presintering. Capacitance values (CV/g) of 7000–10,000 were obtained for primary powders and were about 10% lower for corresponding secondary powders.

Figure 3:
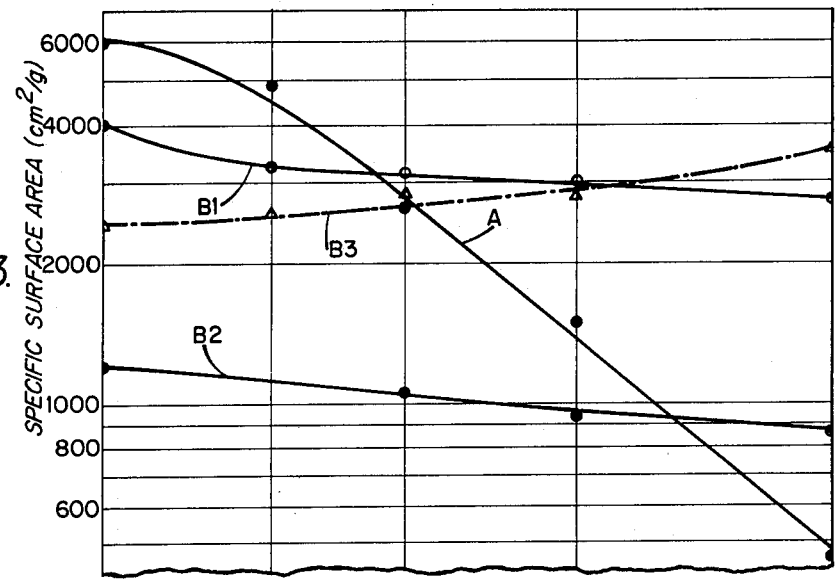
FIGS. 3–5 are log-log curves of specific surface area, capacitance and bulk density, respectively, plotted against sizes of powders produced through said process compared with similar curves for powders produced through prior art processes.
Figure 4:
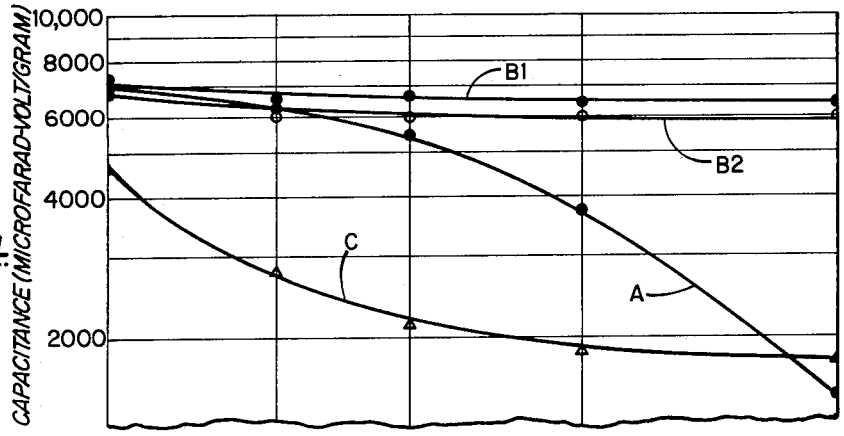
Figure 5:
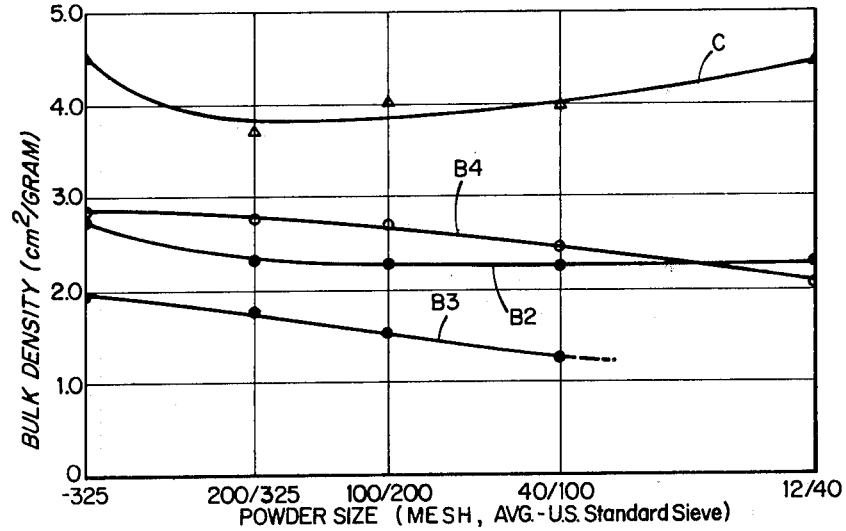

Surface area, capacitance and bulk density for the runs of Example 2 (B3 and B4) are added to the FIGS. 3 - 5 tables.

The uniform bulk density characteristic provides greater production uniformity for die fill and sinter processing in making anodes or other consolidated powder products. The uniform bulk density is low enough to allow for densification to pressed green density and sinter density levels which preserve high internal surface area in the pressed and sintered products made from the powder.

The present invention is not limited to the above described example of the reaction between metallic sodium and potassium fluotantalate, using different dilution ratios of sodium chloride. Rather, the powder characteristics described in the above embodiments may be achieved in a number of different metals in powder form. These achievements include obtaining essentially constant (within ± 20% about a median value) specific capacitance over a fine to coarse powder size spectrum for valve metals and essentially constant bulk density and specific surface area for both valve metals and non-valve metals.

Double halide salts of other elements may be mulled with reducing agent prior to the reduction reaction, requiring the reduction exotherm to occur at a temperature below the solidus of the particular double halide salt.

Suitable fluoro- (fluo) and chloro- double salts, found among Group II, III, IV, V of the periodic arrangement of the elements, include, but are not restricted to, the following potassium salts: — fluoberyllate ($K_2BeF_4$), — fluoborate ($KBF_4$), — fluogermanate ($K_2GeF_6$), — fluothorate ($K_2ThF_6$), — fluotitanate ($K_2TiF_6$). — fluohafnate ($K_2H_fF_6$), — fluozirconate ($K_2ZrF_6$), — fluoniobate ($K_2NbF_7$), — fluotantalate ($K_2TaF_7$). Additional dihalide salts of potassium, other than fluo-salts, may also be used; subject to their chemical stabilities and melting points. Other alkali metal double salts may be so utilized. The invention may also be applied to any of the chemically stable metal halides with sufficiently high melting points to permit the reduction reaction to be initiated at a temperature below the solidus temperature of the halide. Several halides of Group VIII, including iron and nickel can be thus employed. Specific examples are iron fluorides and chlorides ($FeF_3$, $FeF_2$, $FeCl_3$, $FeCl_2$), nickelous chloride ($NiCl_2$), ruthenium chloride ($RuCl_3$), rhodium chloride ($RhCl_3$), palladium chloride ($PdCl_2$), osmium chloride ($OsCl_3$), iridium chloride ($IrCl_2$, $IrCl_3$), platinum bromide ($PtBr_2$, $PtBr_4$), platinum iodide ($PtI_2$, $PtI_4$). In addition, the halides of the rare earth metals (Group III) are also suitable. Some examples of suitable rare earth halides are: lanthanum chloride and iodide ($LaCl_3$, $LaI_3$), cerium chloride and fluoride ($CeCl_3$, $CeF_3$), samarium chloride and iodide ($SmCl_3$, $SmI_3$). The metal powder separation of the reactive rare earth would be accomplished by vacuum distilling off the salt by-products rather than leaching in aqueous media.

In addition, the fluorides and chlorides of manganese and chromium also can be used ($MnF_2$, $MnF_3$; $CrF_2$, $CrF_3$, $CrCl_2$, $CrCl_3$).

The reducing agents are selected from the class consisting of sodium, potassium, lithium, and NaK.

The choice and quantity of diluent is based on a suitable liquidus eutectic temperature to permit the high temperature, stirred, hold period which follows the reduction reaction; being governed by both the particular metal bearing compound and reducing agent employed.

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the scope and spirit of the appended claims.

I claim:

1. Metal powder as produced by mixing particles of a metal salt selected from the group consisting of tantalum and columbium with a molten reducing agent and stirring the salt and reducing agent to produce homogeneous admixture, the salt and reducing agent being selected as constituents of an exothermic reaction initiable at 100°–500° C, raising the temperature of the mixture to said reaction initiating temperature and stirring, continuing said stirring while the exothermic reaction proceeds, and thereafter maintaining melting temperature of all reaction products excepting the metal freed by addition of heat thereto for a period of at least 15 minutes, and continuing the stirring during the reaction period and for at least an initial portion of the whole period to cause large scale order of the reaction products to be essentially continually broken down and to produce homogeneous admixture of unconsumed reactives and products, then cooling the reaction products and freeing metal powder from the reaction products, having a spectrum of powder size distribution from 3 micron to 10 mesh (U.S. Standard) with bulk density and specific surface area of various fractions in this said spectrum being essentially constant.

2. Metal powder as produced by mixing particles of a metal salt selected from the group consisting of tantalum and columbium with a molten reducing agent and stirring the salt and reducing agent to produce homogeneous admixture, the salt and reducing agent being selected as constituents of an exothermic reaction initiable at 100°–500° C, raising the temperature of the mixture to said reaction initiating temperature and stirring, continuing said stirring while the exothermic reaction proceeds, and thereafter maintaining melting temperature of all reaction products excepting the metal freed by addition of heat thereto for a period of at least 15 minutes, and continuing the stirring during the reaction period and for at least an initial portion of the whole period to cause large scale order of the reaction products to be essentially continually broken down and to produce homogeneous admixture of unconsumed reactives and products, then cooling the reaction products and freeing metal powder from the reaction products, having a spectrum of powder size distribution from 3 micron to 10 mesh (U.S. Standard) with specific capacitance of various fractions in this said spectrum being essentially constant.

3. Primary metal powder selected from the group consisting of tantalum and columbium and having a spectrum of powder size distribution from 3 micron to 10 Mesh (U.S. Standard) with bulk density and specific surface area of various fractions in this said spectrum being essentially constant.

4. Primary metal powder selected from the group consisting of tantalum and columbium and having a spectrum of powder size distribution from 325 Mesh to 10 Mesh (U.S. Standard) with specific capacitance of various fractions in said spectrum being essentially constant.

* * * * *